US006092238A

United States Patent [19]

Fierabend, Jr.

[11] Patent Number: 6,092,238

[45] Date of Patent: Jul. 25, 2000

[54] LEADER GRIPPER GLOVES

[76] Inventor: Richard K. Fierabend, Jr., 12827 N. 51 Dr., Glendale, Ariz. 85304

[21] Appl. No.: 09/377,522

[22] Filed: Aug. 19, 1999

[51] Int. Cl.[7] ..... A41D 19/00

[52] U.S. Cl. ..... 2/161.8; 2/16; 2/161.1; 2/161.5

[58] Field of Search ..... 2/16, 159, 160, 2/161.1, 161.5, 161.6, 163; 15/227; 473/59, 450, 458

[56] References Cited

U.S. PATENT DOCUMENTS

| | | | |
|---|---|---|---|
| 1,279,855 | 9/1918 | Garvey | 2/160 |
| 2,187,430 | 1/1940 | Olmsted et al. | 2/160 |
| 2,242,318 | 5/1941 | Mosier | 2/159 |
| 2,980,915 | 4/1961 | Peterson | 2/160 |
| 4,864,660 | 9/1989 | Sawyer | 2/161 |
| 5,022,094 | 6/1991 | Hames et al. | 2/161 A |
| 5,353,440 | 10/1994 | Meldeau | 2/161.1 |
| 5,419,014 | 5/1995 | Piantedosi | 15/227 |
| 5,953,751 | 9/1999 | Kobren | 2/16 |

*Primary Examiner*—Bibhu Mohanty
*Assistant Examiner*—Katherine Moran
*Attorney, Agent, or Firm*—Patent & Trademark Services; Thomas Zack; Joseph H. McGlynn

[57] ABSTRACT

A hand glove having a series of generally parallel finger stall indentations. These finger stall indentations are used to receive a fishing leader line and to provide a firm gripping surface when the user's hand is closed in a closed fist manner. The individual indentations are formed in pad bases fixed to the finger stalls. Each indentation extends across the width of each pad base and is aligned in a generally straight line with an indentation in the other finger stalls. There are five such generally straight line indentations in the four finger stalls with each straight line of indentations being parallel to the other straight lines of the indentations. The indentation in the pad bases upper portion is opened at its top and closed by the material of the pad base at the bottom. The more indentations engaged by a gripped fishing leader line insures a greater amount of frictional contact to prevent the line from slipping out from glove and its indentations as the user's gloved hand is closed around the line.

3 Claims, 2 Drawing Sheets

LEADER GRIPPER GLOVES

BACKGROUND OF THE INVENTION

This invention relates to gloves specifically designed to protect the hands of a user when gripping a fishing leader wrapped around one or both of them. In the past, hand protective gloves have been specifically developed to suit the known needs of the user. Examples abound including golfers' gloves, baseball gloves, gloves for outdoor workers, fireproof gloves, etc. In one case added apertures are incorporated into the portions of the glove to allow for a firmer contact between the bare hand portions and the object grasped, like a golf club. In other cases, there is added protective padding located at specific locations on the user's hand, like the palm, the finger stalls and thumb where hand engagement with external surfaces is contemplated. In some cases wrap around extensions to gloves are employed to permit the better gripping of an object between the extension's end and joined palm and fingers of the glove, such as a tennis racket. In one grip glove, an auxiliary grip having a protuberance on the grip strap is used to provide a bearing surface against a cylindrical object.

The present invention is directed to a glove having its main use in the fishing field to permit the improved gripping of a fishing leader line wrapped around four fingers all as will be described in detail hereafter.

DESCRIPTION OF THE PRIOR ART

Hand protective gloves designed for specific purposes are well known. For example, in the U.S. Pat. No. 2,242,318 to Mosier a glove and mitt is disclosed having apertured portions in its front face particularly the in the palm and base portions of the finger stalls.

U.S. Pat. No. 4,864,660 to Sawyer discloses a flexible hand-conforming protective glove having a back hand protective package.

U.S. Pat. No. 5,022,094 to Hames et al. discloses a gripping glove for securely retaining an object, like a tennis racket. The glove has a strap-like extension from the wrist on the back side of the glove which extends therefrom to join with the ends of several fingers with the object to be clenched placed between the finger ends of the end of the extension.

U.S. Pat. No. 5,353,440 to Meldeau discloses a grip glove with an auxiliary grip having a protuberance on the grip strap used to provide a bearing surface against a cylindrical object.

The present invention differs from this cited prior art and the known prior art by providing for a glove having a series of generally parallel grooves which extend across the fingers stalls for the four fingers.

SUMMARY OF THE INVENTION

This invention relates to a glove have a series of generally parallel grooves which extend across the fingers stalls for four fingers.

It is the primary object of the present invention to provide for an improved gripping glove particularly designed to firmly grip a fishing leader line wrapped around the fingers of a user.

Another object is to provide for such a gloves wherein only the finger stalls, exclusive of the thumb stall, have parallel grooves extending widthwise and parallel of them.

These and other objects and advantages of the present invention will become apparent to readers from a consideration of the ensuing description and the accompanying drawings.

DESCRIPTION OF THE PREFERRED EMBODIMENT

Figure 1:
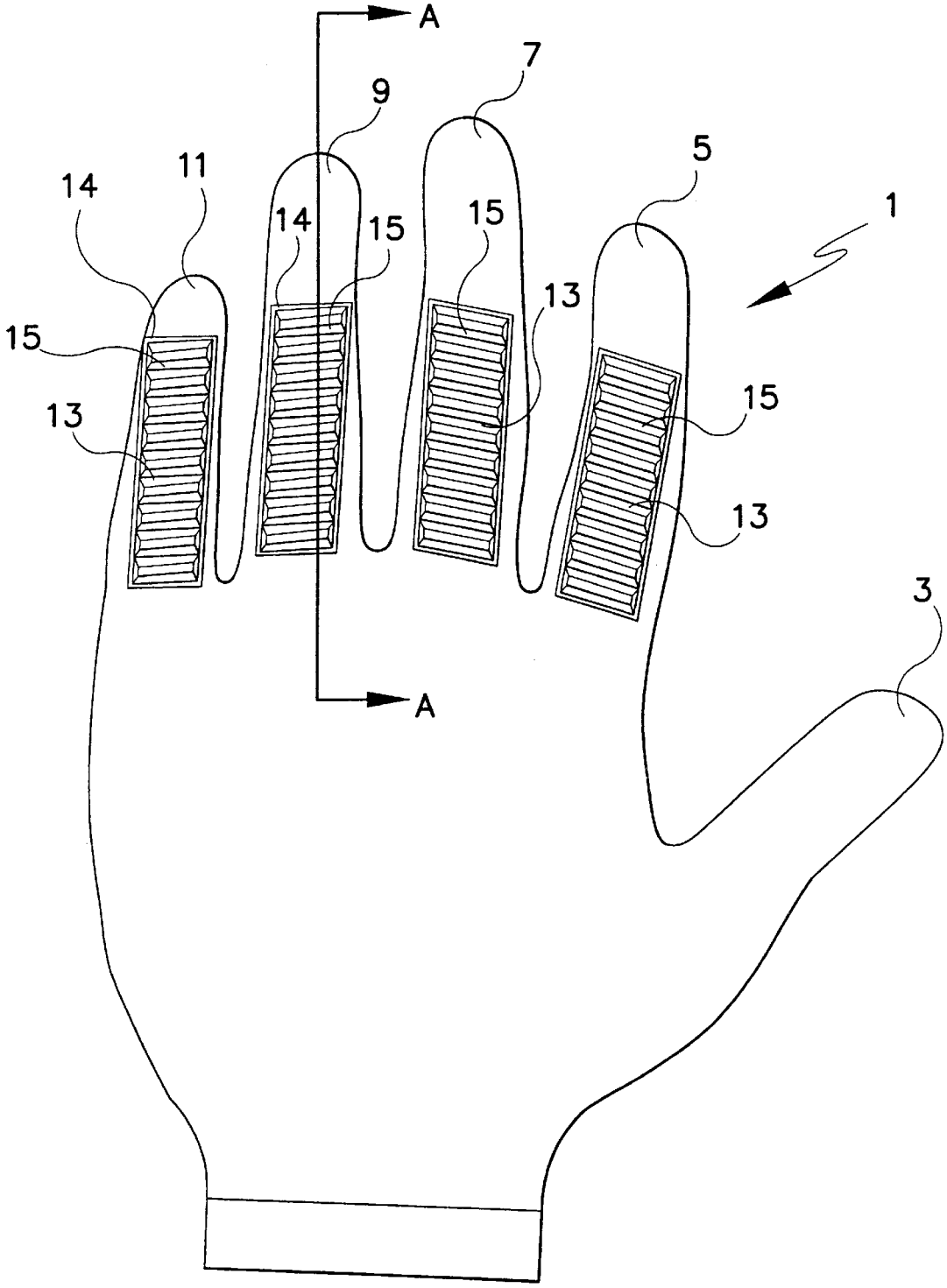
FIG. 1 is a top view of the present invention.

FIG. 1 is a top view of the present invention. A right hand glove 1 is illustrated, it being understood that a left handed glove would have substantially the same construction. Like conventional gloves there is one thumb stall 3 and four separate fingers stalls 5,7,9 and 11. Much of the general outline of glove 1 is conventional, except for the series of parallel indentations 13 that extends across the width of all four finger stalls. In the embodiment shown five generally parallel indentations in each finger stall extend into the adjacent finger stalls widthwise for each of the four fingers. Each of these individual parallel indentations 13 for a given finger stall, for example finger stall 11, is mounted on the same pad backing base 14. This base is in turn fixed to the finger stall on the interior or palm side of the glove. Each pad base 14 is rectangular shaped with the greatest rectangular dimension extending in the same direction as the greatest dimension or length of the finger stall on which mounted. Each of the indentations 13 in a given finger stall is generally aligned with an indentation in each of the other three finger stalls. For example, if the indentation nearest the free end of the finger stalls is designated indentation 15, then all of the four indentations 15 would be aligned in a straight line which extends across into each of the four separate finger stalls. Thus, with four finger stalls and five parallel indentations there would be a total of 20 separate finger stall indentations fixed to one glove. Four separate finger pad bases 14, one for each separate finger, would have at least one of their indentations aligned in a straight line with three of the other indentations on each of the other three finger stalls.

Figure 2:
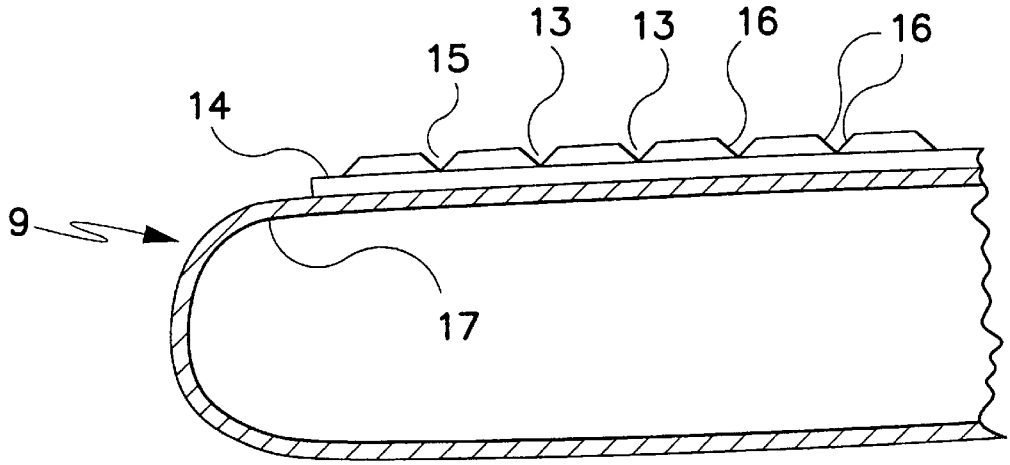
FIG. 2 is a side cross-sectional taken along line A—A of FIG. 1.

FIG. 2 is a side cross-sectional taken along line A—A of FIG. 1. In this view the cross section is taken of the hollow closed at one end finger stall 9, it being understood the three other finger stalls of the glove would have similar cross-sectional views. The indentation 15, nearest the finger tips and nails, is parallel to the other four finger indentations generically represented by the number 13. Each indentation extends downwardly from the exterior surface of its finger stall into the material making up the base 14 but not into the glove material making up the tubular shaped finger stall. As will be better shown in the next figure, the indentations have a cross sectional shape that is narrower on the bottom near where it joins the base 14 than on the opened top portion. Below the bottom of the base material underlying the indentations is the material which actually makes up the finger stalls for the glove, like a natural or synthetic fabric material 17. To provide for the indentations on the top surfaces of the four fingers, the material of base 14 attached to the fabric 17 is built-up or thicker on the inner sides of the finger stalls, i.e., the finger stalls sides with a user's fingerprints bear against and are opposite to the sides of fabric 17 that bear against a user's end fingernails. The glove fabric material 17, as is conventional, extends to cover all of the four finger stalls, the thumb stall 3 and the covered glove palm and back up to the wrist hand opening.

Figure 3:
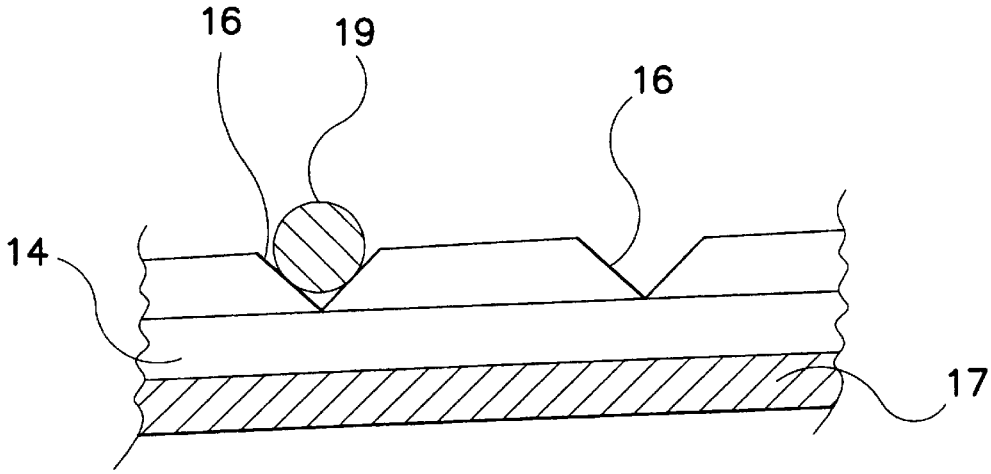
FIG. 3 is an enlarged cross-sectional view of one of the parallel grooves shown in FIG. 2.

FIG. 3 is an enlarged cross-sectional view of one of the parallel indentations grooves 15 shown in FIG. 2. Extending upwardly from the lower pad backing base 14, are two spaced molded sides 16. Between these sides raised sides 16 is the material of the base 14. Also shown in cross section in this third figure is the leader fishing line 19—also in dotted line format in FIG. 1—which line rests against the pad base 14 between the elevated raised sides 16 forming the indentations. The line 19 would be more likely retained in the bottom of the indentation or groove 13 when a user wraps this line around their clenched gloved fist when pulling against a caught fish on the free hooked end of the leader. The parallel indentations in each finger stall provide an increased gripping function when the leader line is partially or totally inserted into each of the five separate aligned indentations that run across the four finger stalls. Should the insertable indentation line 19 slip from one of the series of aligned indentations (e.g., aligned indentations 15) in each finger stall or be initially placed on the finger stalls between parallel aligned indentations, there is an increased likelihood that the tensioned moving leader line will fall into the nearest aligned finger stall indentation 13 and be retained therein as the user closes his or her gloved hand around the line. This construction provides for a very sure gripping of the wet leader line at the same time. Ideally all five aligned and parallel indentations 13 in each finger stall should be engaged by the leader line, however, such may not be possible and the larger the number of indentations engaged the greater will be the frictional contact between the leader line and the pads fixed to glove's surface.

Clearly, the principles behind this invention may find applicability in other fields rather than fishing and the retaining of fishing lines. Whenever, there is a slippery object capable of being retained in a groove of a glove with the series of indentations, there will began increase in the gripping resistant for the seated object in the indentation(s). The base pad 14, including the elevated spaced sides 16, should be made of a material having a high frictional resistance, like rubber or a speciality plastic, to insure there is little or no slippage between the pad and the retained wet line 19. Normally, the individual pad bases for each finger stall and their individually formed parallel indentations are molded together as one unit before being fixed to the finger stalls.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A hand glove comprising:

four separate finger stalls each having a width and a length, each of said finger stalls being adapted to be mounted over an individual separate finger of a user;

a pad base for each of said four finger stalls, each of said pad bases being fixedly mounted on each of said finger stalls, each of said pad bases having four indentations that continously extend substantially the total width of the finger stall, each of the indentations on each pad base being adapted to receive and assist in the retaining of a line insertable in the indentation;

each indentation in each finger stall being generally aligned in a straight line with an individual indentation in an adjacent finger stall, said indentations in each finger stall being parallel to the indentations in that finger stall and parallel to the indentations in the other finger stalls;

said indentations in each pad base extending downwardly into the material making up the pad base, said indentations having a cross section formed in the pad that is narrower at the bottom near where it joins the finger stall than at the opened top of the pad;

each indentation in each pad base being adapted to receive a line that extends along the width of a finger stall and any aligned indentations in adjacent finger stalls; and each of said finger stalls being tubular shaped and made of a material fabric, each of said indentations in the pad bases on each of said finger stalls being formed by a closed bottom pad base portion which is fixed to the material fabric of the finger stall and has spaced elevated sides.

2. The hand glove as claimed in claim 1, wherein there are five parallel indentations on each finger stall, each of said five indentations extending across the width of each finger stall.

3. The hand glove as claimed in claim 2, wherein the material making up the pad base for each of the finger stalls has a lower portion on the same side as the material of the finger stall to which the pad base is fixed.

* * * * *